US009788582B2

(12) United States Patent
Carrer et al.

(10) Patent No.: US 9,788,582 B2
(45) Date of Patent: Oct. 17, 2017

(54) GARMENT STRUCTURE TO LIFT GLUTEI AND THIN HIPS

(71) Applicants: Alessandra Carrer, San Quirino (IT); Michela Moresco, Treviso (IT)

(72) Inventors: Alessandra Carrer, San Quirino (IT); Michela Moresco, Treviso (IT)

(73) Assignee: FORM IQ LLC, Galloway, OH (US)

( * ) Notice: Subject to any disclaimer, the term of this patent is extended or adjusted under 35 U.S.C. 154(b) by 94 days.

(21) Appl. No.: 14/823,665

(22) Filed: Aug. 11, 2015

(65) Prior Publication Data

US 2017/0042257 A1 Feb. 16, 2017

(51) Int. Cl.

| | |
|---|---|
| ***A41D 1/06*** | (2006.01) |
| ***A41D 13/02*** | (2006.01) |
| ***A41C 1/00*** | (2006.01) |

(52) U.S. Cl.

CPC ..... *A41D 1/06* (2013.01); *A41D 2300/22* (2013.01); *A41D 2400/38* (2013.01)

(58) Field of Classification Search

CPC .. A41D 1/06; A41D 13/0537; A41D 2300/22; A41D 2400/38

USPC ..... 2/227, 79, 401, 69; 450/122–124

See application file for complete search history.

(56) References Cited

U.S. PATENT DOCUMENTS

| | | | | |
|---|---|---|---|---|
| 3,835,866 A * | 9/1974 | Brooks | A41C 1/003 | 450/123 |
| 5,888,118 A | 3/1999 | Kishi | | |
| 6,035,448 A * | 3/2000 | Thomson | A41D 1/06 | 2/227 |
| 7,087,032 B1 * | 8/2006 | Ikeda | A61F 5/03 | 128/891 |
| 2009/0031470 A1 | 2/2009 | Ishikawa et al. | | |
| 2011/0197342 A1 | 8/2011 | Lee | | |
| 2013/0312157 A1 * | 11/2013 | Freddi | A41D 1/06 | 2/227 |
| 2014/0273742 A1 * | 9/2014 | Hays | A41D 1/06 | 450/95 |
| 2014/0310854 A1 * | 10/2014 | Kianmahd | A41D 1/06 | 2/237 |

(Continued)

FOREIGN PATENT DOCUMENTS

| | | | |
|---|---|---|---|
| CA | 2509040 A1 * 11/2006 | A41D 1/06 | |
| JP | 2004-332153 11/2004 | | |
| JP | WO 2005029987 A1 * 4/2005 | A41C 1/02 | |

(Continued)

OTHER PUBLICATIONS

Search Report and Written Opinion from IT TV20130209 dated Aug. 14, 2014.

*Primary Examiner* — Jameson Collier
(74) *Attorney, Agent, or Firm* — Calfee, Halter & Griswold LLP

(57) ABSTRACT

A garment structure is provided to lift glutei and thin hips. The structure includes a belt, a front part, and a rear part joined to the front part by leg side seams and inner thigh seams. The rear part includes at least two polygon-shaped deformable elastic bands. Each deformable elastic band has a side joined to a leg side seam and a side joined by a final lower seam part arranged into the cleft between the glutei and affecting the inner thigh seam. The bands are linked starting from an adjoining point of the inner side seam to at least a point lying in the area under the line passing through the center of the glutei.

8 Claims, 4 Drawing Sheets

(56) References Cited

U.S. PATENT DOCUMENTS

| | | | | |
|---|---|---|---|---|
| 2015/0128331 | A1* | 5/2015 | Grosse | A41D 13/0017 2/400 |

FOREIGN PATENT DOCUMENTS

| | | | | | |
|---|---|---|---|---|---|
| JP | 2005-256219 | | 9/2005 | | |
| JP | WO 2006115066 | A1 * | 11/2006 | ..... | A41D 1/06 |
| JP | EP 2181613 | A1 * | 5/2010 | ..... | A41C 1/02 |

* cited by examiner

GARMENT STRUCTURE TO LIFT GLUTEI AND THIN HIPS

BACKGROUND

A relatively high demand exists for garments, such as pants, which are able to lift the glutei and thin the hips of a person wearing them. Knitted fabric is well-known as a "soft fabric" to shape glute but it cannot fit just any shape or modify it and therefore doesn't allow substantial lifting.

Prior art solutions include Italian patent MI2012A000904, registered on May 24, 2012, and disclosing pants to shape female glutei. This patent discloses pants having a first rear section (2, 102, 202) suitable for covering glutei, at least partially, and a second front section (1, 101, 201) suitable for covering the abdomen, at least partially. The first rear section (2, 102, 202) includes: at least a first element (7B, 107B, 207B) suitable for covering at least the final lower section (S1) and the side section (S2) of the glutei, at least a second element (9, 109, 209) suitable for covering at least the central section (S3) of the glutei, and another third element (4, 10, 104, 110, 204, 210) suitable for covering at least the final upper section (S2) of the glutei, distinguished by the fact that the first (7B, 107B, 207B), second (9, 109, 209), and third (10, 4, 110, 104, 210, 204) elements include knitted fabric, that the first element (7B, 107B, 207B) and the third element (10, 110, 210) mark out a central opening (40,140, 240), that the external edges (9C, 9D, 109C, 109D, 109E, 209C, 209D, 209E) of the second element (9,109,209) are limited to the edges (7H, 10A, 107H, 110A, 207H, 210A) marking out the opening of the first element (7B, 107B, 207B) and third element (10, 4, 110 104, 210, 204) in order to close the opening, and that the second element (9, 109, 209) includes two sections (9A, 9B, 109A, 109B, 209A, 209B), each one suitable for covering only one of the two central sections (S3) of the glutei, and that the two sections are limited between each other along their corresponding side edges (9F, 109F, 209F) arranged by the cleft (S4) between the glutei through a central seam line (16) suitable for being arranged by the cleft.

This known technique has some disadvantages including the complicated structure of the pants. Since the structure includes several sections to be sewn together, it needs an opening on the central section of the glutei and needs to be closed according to the shape of a special and complicated paper pattern.

Besides the different and numerous seams arranged in a special way all along the pants, actual lifting requires coupling with other components which may develop an active lifting, such as a cord (18) which nevertheless serves to pull the knitted cloth within the cleft between the buttocks, but actually does not lift them, or a fitting-in section (150*a*) and (150*b*) which in any case, if arranged in the final lower section (S1) and side section (S2) of the buttocks, does not allow the lifting of all the glutei, but only of a section of it. Thus, the body cannot be made slimmer.

All these seams also make the pants less stylish and make it especially apparent that one is trying to shape the glutei, which the wearer of the pants would prefer to keep hidden because of a less than optimal glutei shape.

Other known solutions include the use of an essentially elastic material to sew the desired pants and the whole area of the glutei, wrapping them completely. Even these solutions have disadvantages such as crushing or smashing the glutei. The crushing does not allow for upward lifting and also crushes the glutei sideways and further down so that the person wearing them is not made slimmer but actually large instead.

SUMMARY

The present application describes a garment structure to lift glutei and thin hips, such as, for example, pants.

In an exemplary embodiment, a garment structure is pants and includes a belt, a front part, and a rear part. The rear part includes at least two polygon-shaped deformable elastic bands.

Further features and advantages of the invention will become apparent from the following detailed description made with reference to the accompanying drawings.

BRIEF DESCRIPTION OF THE DRAWINGS

Features and advantages of the general inventive concepts will become apparent from the following detailed description made with reference to the accompanying drawings.

DETAILED DESCRIPTION

Figure 1:
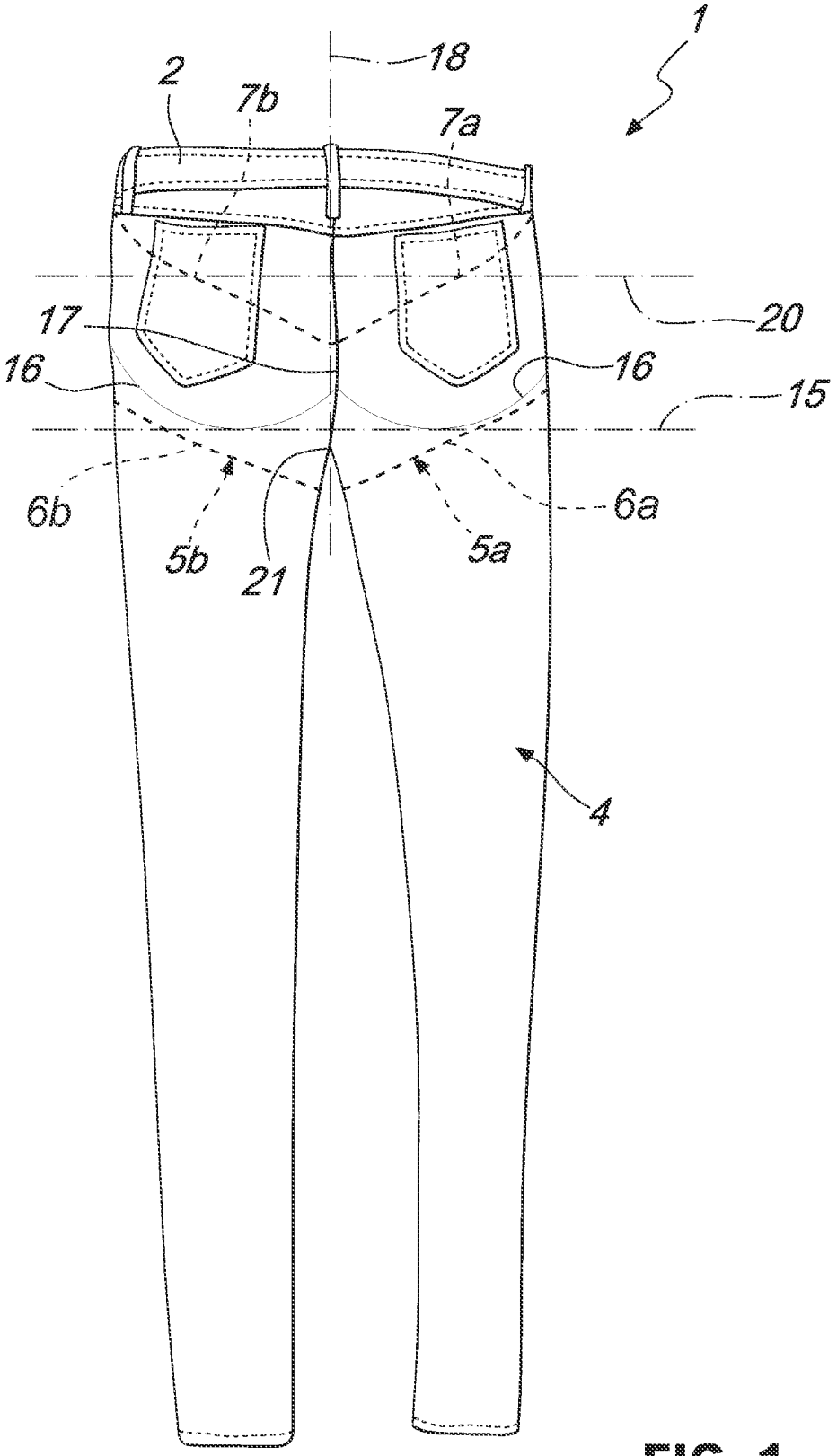
FIG. 1 is a rear view of a garment.
Figure 2:
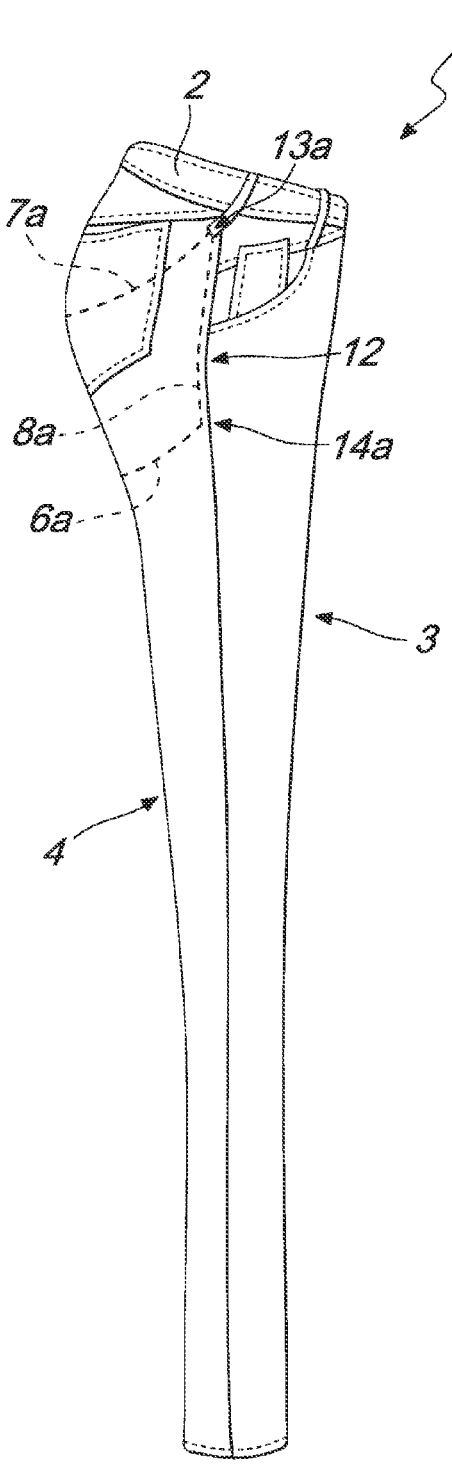
FIG. 2 is a right side view of the garment of FIG. 1, showing the shape of the garment as if worn.
Figure 3:
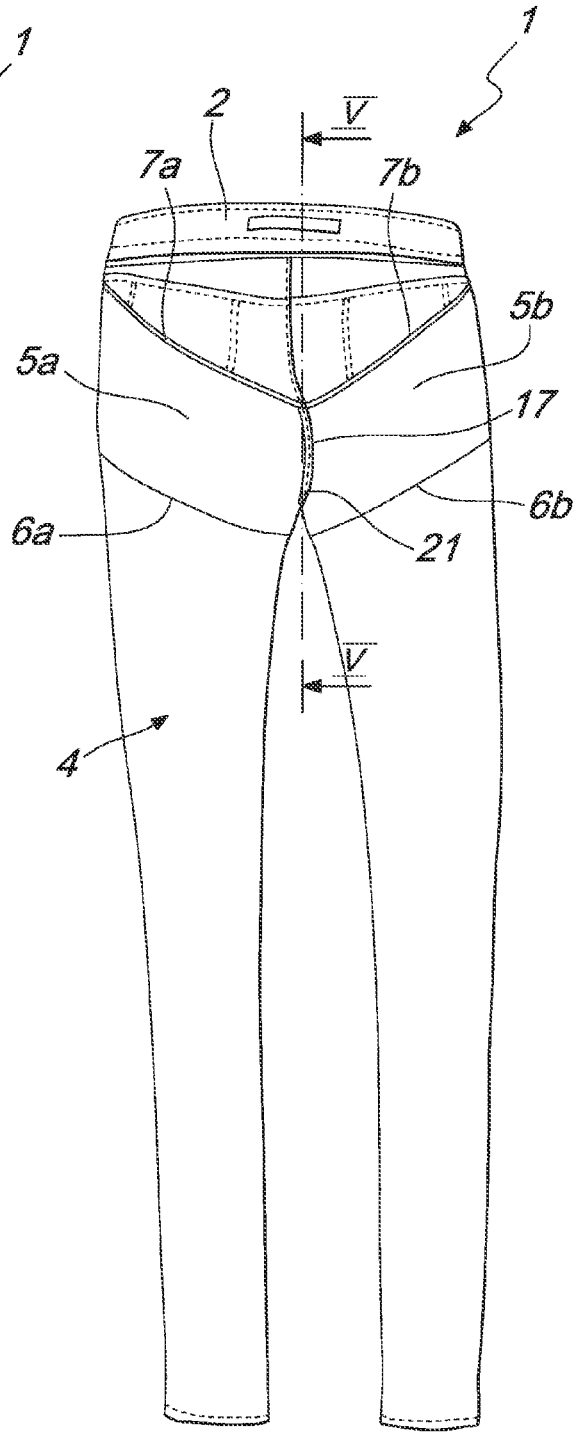
FIG. 3 is a rear sectional view of the garment of FIG. 1, showing two elastic bands.
Figure 4:
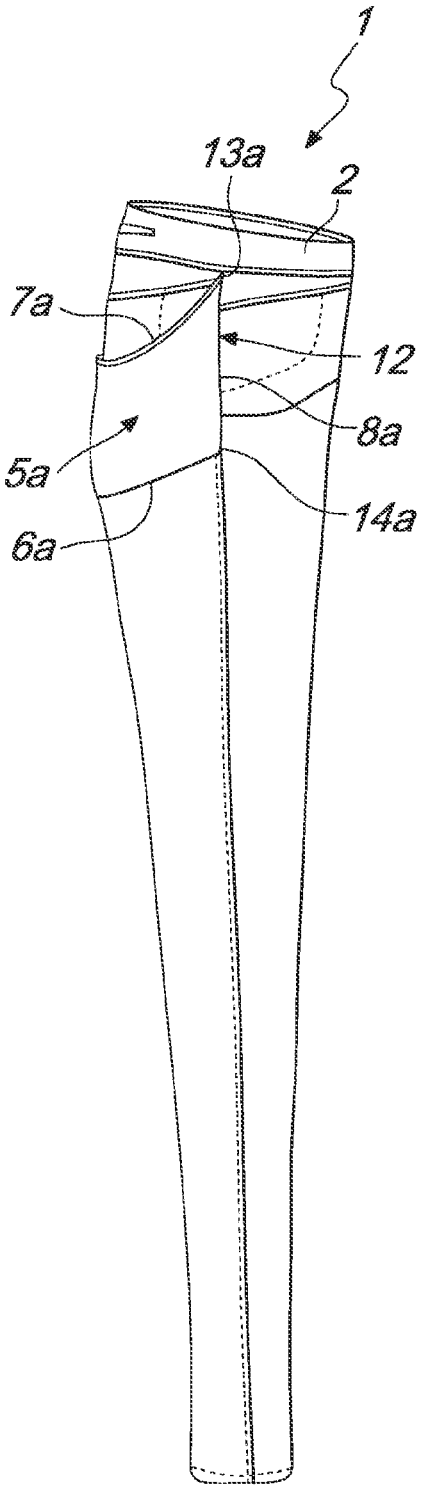
FIG. 4 is a right side sectional view of the garment of FIG. 1, showing the shape of the structure when not worn.
Figure 5:
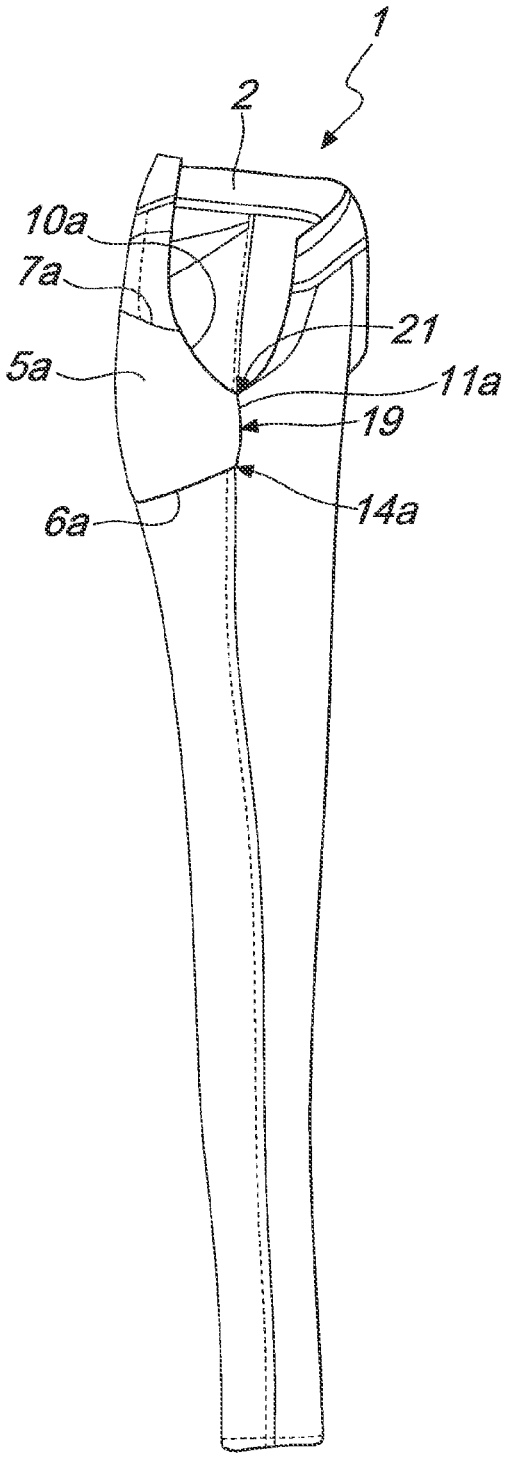
FIG. 5 is a sectional view of the garment of FIG. 1, according to the lines V-V of FIG. 3 and when not worn.

This Detailed Description merely describes exemplary embodiments in accordance with the general inventive concepts and is not intended to limit the scope of the invention or the claims in any way. Indeed, the invention as described by the claims is broader than and unlimited by the exemplary embodiments set forth herein, and the terms used in the claims have their full ordinary meaning.

The general inventive concepts will now be described with occasional reference to the exemplary embodiments of the invention. These general inventive concepts may, however, be embodied in different forms and should not be construed as limited to the embodiments set forth herein. Rather, these embodiments are provided so that this disclosure will be thorough and complete, and will fully convey the scope of the general inventive concepts to those skilled in the art.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, percentages, and so forth as used in the specification and claims are to be understood as being modified in all instances by the term "about." Accordingly, unless otherwise indicated, the numerical properties set forth in the specification and claims are approximations that may vary depending on the suitable properties sought to be obtained in the embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

This application is directed to a garment structure designed to cover portions of the body. The structure may cover different portions of the body, such as for example, pants for the lower section of the body, or pants, skirt, and culottes or clothing/dress for the lower section of the body and the whole chest.

A purpose of this invention is to solve the discussed technical issues and eliminate the disadvantages of discussed known techniques by providing a garment which allows the bottom to be lifted upwards and, at the same time, reduces the hips, the thigh, the bottom, and the pelvis by approximately one clothing size, so as to make the figure of the person wearing this garment slimmer.

Another important purpose of this invention is to make a garment that gives no external signs of bandaging under the garment.

Another important purpose of this invention is to provide a structure with low manufacturing costs which can be made with conventional machinery and facilities.

The mentioned task and purposes as well as others are discussed herein.

In the manufacturing examples below, single features according to specific cases can be in fact interchangeable with other different features of other manufacturing examples.

The exemplary structure discussed is a pair of pants. Alternatively, as external use, the garment can cover some or all of the chest both in case of skirt or culottes or clothing-dress.

Referring now to the Figures, an embodiment of the invention is shown in FIGS. 1-6. FIG. 1 shows a garment structure 1 for lifting the glutei 16 and thinning the hips. The exemplary garment structure is pants to cover the lower body section. The pants include a belt 2, a front section 3, and a rear section 4 sewn between each other. The rear section includes at least two trapezoid-shaped deformable elastic bands 5*a*, 5*b*.

The material of the elastic bands will be discussed in detail. The advantage of this garment is the use of a fabric called "comfort" and following known manufacturing procedures. Inside the garment are at least two deformable elastic bands 5*a*, 5*b* which can be manufactured with different materials such as for example, Lycra® (a type of spandex fiber), jersey, cotton, silk, linen, polyester, nylon, polyamide, paired with the desired elasticity ratio or any other deformable fabric and/or suitable materials.

The shape of the elastic bands will be discussed in detail. Each band 5*a*, 5*b* has a geometrical shape, essentially trapezoidal, marking out a lower, smaller base 6*a*, 6*b*, an upper, larger base 7*a*, 7*b*, and a first and second side 8*a*, 8*b* and 9*a*, 9*b*. The smaller base 6*a*, 6*b* and the larger base 7*a*, 7*b* can be linear or slightly curved, for example, concave turned toward the bottom of the pants. Each second side 9*a*, 9*b* is at least partially unsecured and marks out the first arch-shaped stretch 10*a*, 10*b* which is between the larger base 7*a*, 7*b* and the second linear stretch 11*a*, 11*b*, joined with the smaller base 6*a*, 6*b*.

Each first side (8*a*, 8*b*) is sewn all along its length by the side seam 12 of the leg connecting the mentioned front 3 and rear 4 sections. Each first side 8*a*, 8*b* also has the first edge 13*a*, 13*b* joined with the larger base 7*a*, 7*b* sewn in a point next to the mentioned belt 2. The length of each first side 8*a*, 8*b* is such as to arrange a second edge 14*a*, 14*b*, joined with the smaller base 6*a*, 6*b* at a height essentially corresponding to the tangent line 15 to the lower section of the glutei 16.

The shape and construction of the second sides is different than the first sides. Each second side 9*a*, 9*b* is sewn all along its length by the final lower seam section 17 located in the cleft between the glutei 18 thus affecting the inner thigh seam 9. Especially the first arch-shaped stretch 10*a*, 10*b* of the second side 9*a*, 9*b* affects the seam 17 starting from the area below the line 20 passing through the center of the glutei 16 to the crotch point 21. In contrast, the second linear stretch 11*a*, 11*b* of the second side 9*a*, 9*b* starts from the crotch point 21 thus affecting the inner thigh seam 19. Thus, each smaller base 6*a*, 6*b* has a third end 22*a*, 22*b* joining the second linear stretch 11*a*, 11*b* which is joined with the inner thigh seam 19. Besides that, each band 5*a*, 5*b* is arranged in such a way that the smaller base 6*a*, 6*b* of each band is beneath the tangent line 15 to the lower section of the buttocks 16. Along the stretches corresponding to the smaller base 6*a*, 6*b* and to the larger base 7*a*, 7*b*, each of the bands 5*a*, 5*b* is not sewn to the garment. Alternatively, the larger base 7*a*, 7*b* can be sewn to the aforementioned garment on some points, only in order to keep their position when the pants are being worn. Each band 5*a*, 5*b* can be fixed by different fixing systems or seams or any other suitable fixing means such as buttons of various kinds, Velcro® (a type of hook-and-loop fastener), hooks, zip-fasteners, and adhesive sections. Also, for example, the two bands 5*a*, 5*b* can be previously sewn between each other, before then being sewn to the pants.

Figure 6:
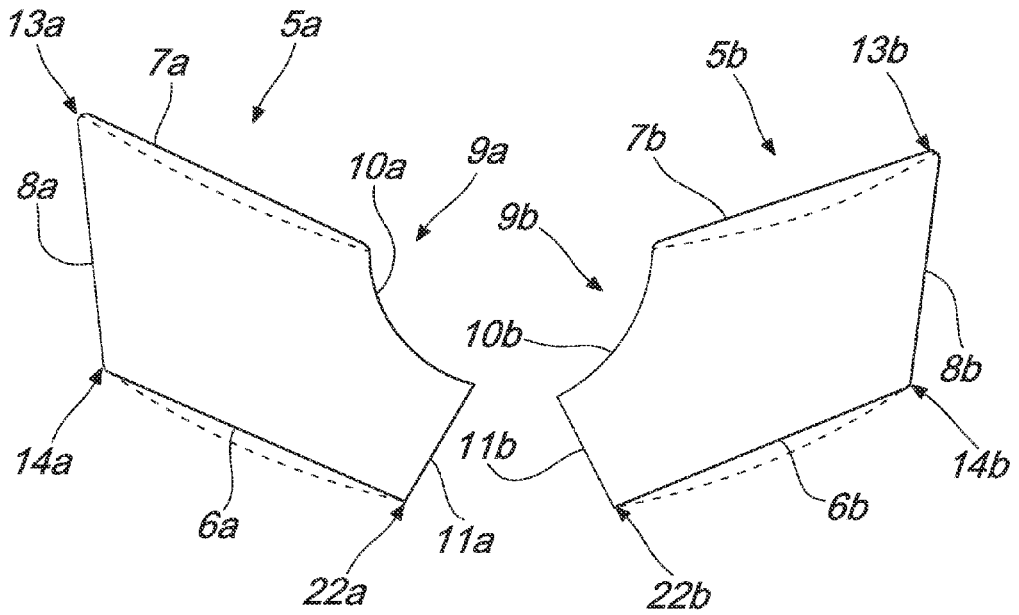
FIG. 6 is a front view of two elastic bands of the garment of FIG. 1.

Exemplary elastic bands 5*a*, 5*b* are shown in FIG. 6. The elastic bands each have sides which are unsecured and sides which are secured with other parts of the garment. For example, the elastic bands 5*a*, 5*b* have outside sides 8*a*, 8*b* that are joined by the side seam of the leg 12 which joins the front section 3 and the rear section 4, and inside sides 9*a*, 9*b* joined by the final lower seam section 17 and arranged on the cleft between the buttocks 18. The elastic bands 5*a*, 5*b* affect seam 19 inside the thigh because the deformable elastic bands 5*a*, 5*b* are arranged with the larger base 7*a*, 7*b* and the smaller base 6*a*, 6*b*, made inclined with the edges of the larger base 7*a*, 7*b* joined starting from a point next to the belt 2 to at least a point lying in the area below the line passing through the center of the glutei 16.

Figure 7:
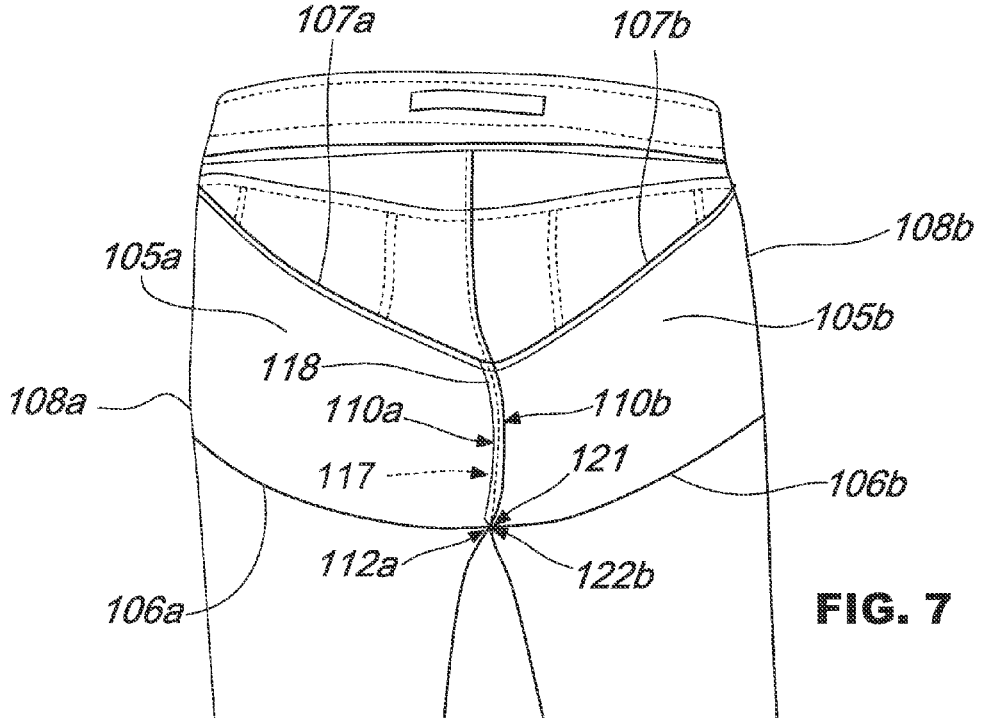
FIG. 7 is a rear sectional view of the another structural garment, showing two elastic bands.

Another embodiment of the invention is shown in FIG. 7. Each band 105*a*, 105*b* has a lower size than the embodiment previously discussed, in such a way that the smaller base 106*a*, 106*b* directly joins the first side 108*a*, 108*b* and a section of the second side, so that the third end 122*a*, 122*b* coincides with the final end of the first arch-shaped stretch 110*a*, 110*b*. In this way, the second linear stretch is missing 11*a*, 11*b*, and the bands are joined by the seam 117 arranged in the cleft between the glutei 118.

The garment structure has fulfilled the expected task and purposes and the result, thanks to the bands 5*a*, 5*b* and their connection points to the pants, is that the bottom is lifted only upwards and the hips, thigh, and pelvis are reduced by at least one size, making the figure of the person wearing the garment slimmer. Specifically, the bands 5*a*, 5*b* allow a traction force lifting the glutei upwards and a side force making the hips slim, while additionally, slimming the inner thigh. Further, since the bands are arranged inside the garment, the garment is not perceived to be a slimming or buttocks lifting garment.

While various inventive aspects, concepts, and features of the general inventive concepts are described and illustrated herein in the context of various exemplary embodiments, these various aspects, concepts, and features may be used in many alternative embodiments, either individually or in various combinations and sub-combinations thereof Unless expressly excluded herein all such combinations and sub-combinations are intended to be within the scope of the general inventive concepts. Still further, while various alternative embodiments as to the various aspects, concepts, and features of the inventions (such as alternative materials, structures, configurations, methods, circuits, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features, and concepts may be expressly identified herein as being inventive or forming part of an invention, such identification is not intended to be exclusive, but rather there may be inventive aspects, concepts, and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed:

1. A garment structure to lift the glutei and thin the hips, the garment structure comprising:

a belt;

a front part;

a rear part joined to the front part by at least two outer leg side seams and two inner thigh seams, the inner thigh seams connecting to one another at a crotch point; and a pair of deformable elastic bands, wherein the belt is situated above the front part and the rear part;

wherein the elastic bands are situated between the front part and the rear part within an interior space of the garment structure;

wherein each elastic band includes a first side, a second side, an upper base extending between the first side and the second side of each respective elastic band; and a lower base extending between the first side and the second side of each respective elastic band;

wherein the upper base of each elastic band is closer to the belt than the corresponding lower base of each elastic band;

wherein the first side of each elastic band is directly joined to a respective one of the outer leg side seams;

wherein the second side of each elastic band includes a portion that is directly joined to a respective one of the inner thigh seams starting at the crotch point;

wherein the first side of each elastic band meets the corresponding upper base of the elastic band at a first point;

wherein the second side of each elastic band meets the corresponding upper base of the elastic band at a second point;

wherein the first side of each elastic band meets the corresponding lower base of the elastic band at a third point;

wherein the second side of each elastic band meets the corresponding lower base of the elastic band at a fourth point;

wherein each first point is closer to the belt than each respective second point; and wherein each third point is closer to the belt than each respective fourth point wherein each second point is situated above the crotch point; and wherein each fourth point is situated below the crotch point.

2. The garment structure of claim 1, wherein the elastic bands are situated below the belt.

3. The garment structure of claim 1, wherein the second side of each elastic band includes a linear portion and an arch-shaped portion, wherein the linear portion of each second side connects to a respective one of the lower bases at the respective fourth point, and wherein the arch-shaped portion of each second side connects to a respective one of the upper bases at the respective second point.

4. The garment structure of claim 3, wherein the arch-shaped portions of the elastic bands are joined together.

5. The garment structure of claim 3, wherein the arch-shaped portion of each second side is not directly secured to the remainder of the garment structure.

6. The garment structure of claim 1, wherein the upper base of each elastic band has a portion between the first point and the second point that is not directly secured to the remainder of the garment structure.

7. The garment structure of claim 1, wherein the lower base of each elastic band has a portion between the third point and the fourth point that is not directly secured to the remainder of the garment structure.

8. The garment structure of claim 1, wherein the second side of each elastic band is arch-shaped and extends between the corresponding second point and the corresponding fourth point.

* * * * *